US005277622A

United States Patent [19]

Liljenberg et al.

[11] Patent Number: 5,277,622

[45] Date of Patent: Jan. 11, 1994

[54] ELECTRIC CONNECTING DEVICE FOR PILOT VALVES IN A VALVE ARRAY

[75] Inventors: Anders Liljenberg, Bromma; Hans Pettersson, Huddinge, both of Sweden

[73] Assignee: AB Rexroth Mecman, Stockholm, Sweden

[21] Appl. No.: 934,676

[22] PCT Filed: Mar. 6, 1991

[86] PCT No.: PCT/SE91/00176

§ 371 Date: Sep. 3, 1992

§ 102(e) Date: Sep. 3, 1992

[87] PCT Pub. No.: WO91/15037

PCT Pub. Date: Oct. 3, 1991

[30] Foreign Application Priority Data

Mar. 29, 1990 [SE] Sweden ..... 900157-8

[51] Int. Cl.[5] ..... H01R 13/00

[52] U.S. Cl. ..... 439/499

[58] Field of Search ..... 439/492–499

[56] References Cited

U.S. PATENT DOCUMENTS

| | | | |
|---|---|---|---|
| 3,102,767 | 9/1963 | Schneck | 439/493 |
| 3,230,498 | 1/1966 | Keys | 439/493 |
| 3,731,254 | 5/1973 | Key | 439/494 |
| 4,257,028 | 3/1981 | Narozny et al. | 439/494 |

FOREIGN PATENT DOCUMENTS

| | | |
|---|---|---|
| 0278430 | 8/1988 | European Pat. Off. . |
| 469373 | 2/1969 | Fed. Rep. of Germany . |
| 3637008C2 | 9/1988 | Fed. Rep. of Germany . |
| 560470 | 2/1975 | Switzerland . |

*Primary Examiner*—Joseph H. McGlynn
*Attorney, Agent, or Firm*—Townsend and Townsend Khourie and Crew

[57] ABSTRACT

Electric connecting device for electrically controlled, so called pilot valves (21–25) connected to a corresponding number of valves (1–5) in a modular valve array. Each pilot valve has equally placed contact pins (26,27,28), which are connected to a common, flexible connecting cable (29) with a plurality of conductors (29) over an electric connecting module (30). Each connecting module (30) is constituted by a coupling plate (32) provided with on the one hand contact sockets (33,34,35) for connection to said contact pins (26,27,28) of the respective pilot valve, and on the other hand a multipolar contact means (37), which is connectable to a corresponding cable contact means (38), which is connected to conductors of the common connecting cable (29). The coupling plate (32) is provided with an array of preferably controllable electrical connections (36) for the desired connection between said multipolar cable contact means (37) and said contact sockets (33,34,35).

10 Claims, 2 Drawing Sheets

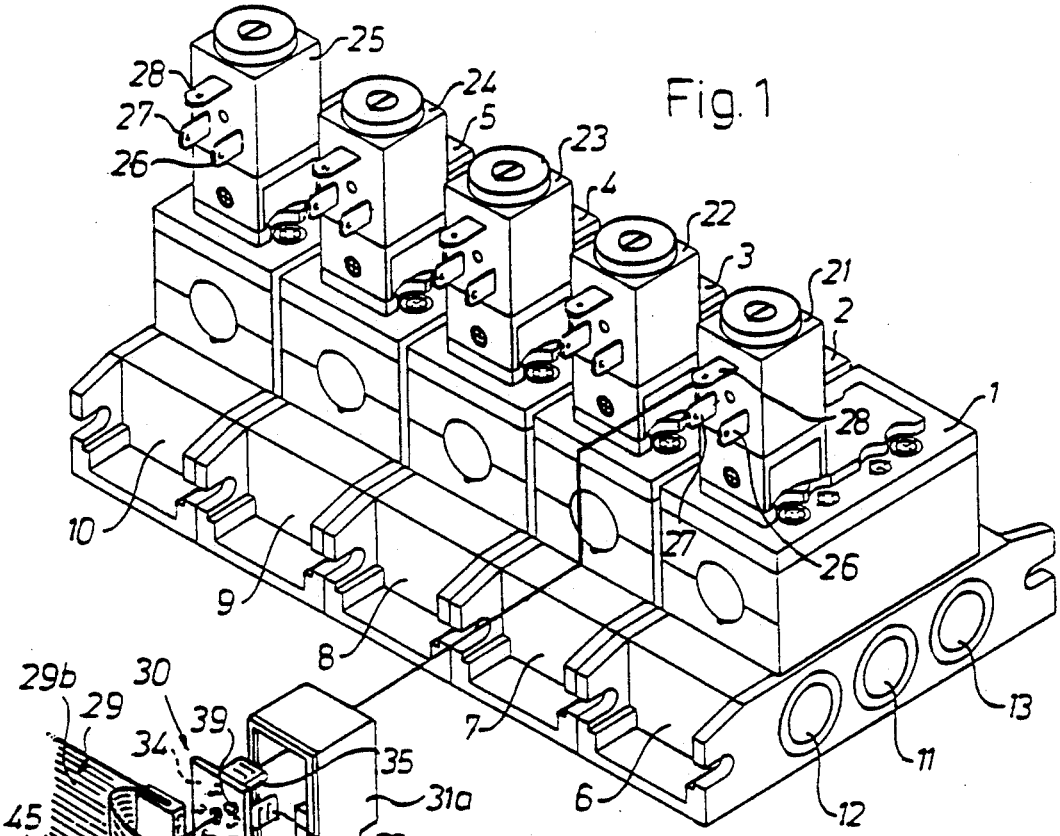
Fig. 1
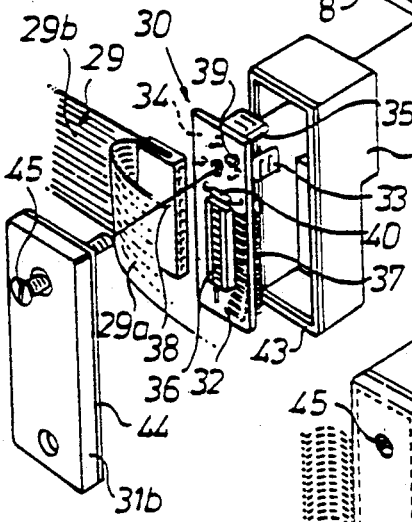
Fig. 2
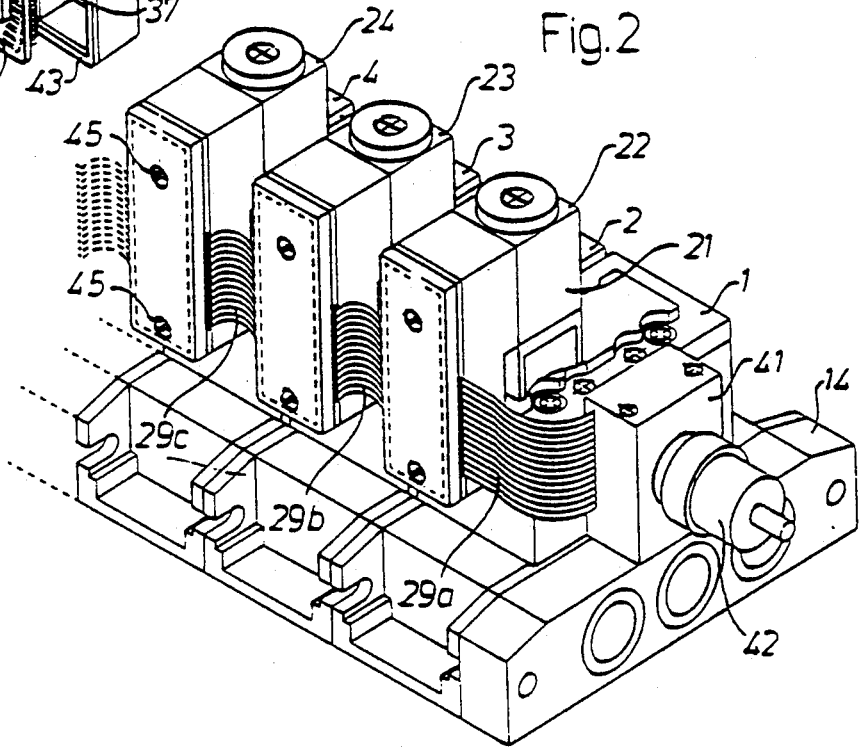

ELECTRIC CONNECTING DEVICE FOR PILOT VALVES IN A VALVE ARRAY

BACKGROUND OF THE INVENTION

The present invention discloses generally an electric connecting device for electrically controlled fluid valves, and more specifically pilot valves connected to a corresponding number of main valves in a modular valve array. Each pilot valve has equally placed contact pins, normally three contact pins, which are to be connected to an inter-connecting cable with a plurality of conductors via an electric connecting module. By "a corresponding number" is meant either that each main valve (in particular a pneumatic, directional valve) has a single pilot valve or that at least two pilot valves are mounted on each main valve for controlling the function thereof.

In a known connecting device of a similar kind, the connecting modules are contained in a special plug-in-unit, which is mechanically fixed to the main valves and contains electrical connections, which are connected to the contact pins of the pilot valves in a predetermined manner. Thus, a plug-in-unit of this kind must be adapted to the dimensions of a particular valve array and the number of valves therein.

SUMMARY OF THE INVENTION

The aim of this invention is to achieve a flexible connecting device, which can be adjusted to different valve arrays in a simple manner, whereby the electrical as well as the mechanical connection can be varied in a simple manner and whereby the electrical as well as the mechanical connection can be varied by simple means as desired.

This aim is achieved according to the invention with a connecting device comprising a plug-in module having a coupling plate provided with contact sockets sized and arranged for direct connection to contact pins of an associated fluid valve, a multipolar contact means connectable to one of said multipolar cable contact means, a number of multipolar cable contact means interconnected between flexible positions of the multi-conductor cable, and a number of plug-in modules to be mounted onto a respective one of the fluid valves and electrically connectable to said multipolar cable contact means. The device further includes an array of interruptable electric connections, in particular contact bridges, between the multipolar contact means and the contact sockets. Hereby, the respective plug-in module is programmable for achieving a selectable connection between the contact pins of the associated fluid valve and specific conductors of the inter-connecting cable. The latter is preferably comprised of a flat cable and facilitates a desired electric series connection of the pilot valves irrespective of their relative order and distance. Thus, the connecting device according to the invention may be adjusted in a very simple way to the valve array in question, i.e. to different mechanical constructional details (type, number, relative distance, etc.), as well as to different electric coupling arrangements (by exchanging the coupling plate or selectively controlling the contact bridges of the respective coupling plate).

Further advantageous features will be apparent from the following detailed description of a preferred embodiment, reference being made to the annexed drawings.

BRIEF DESCRIPTION OF THE DRAWINGS

FIG. 1 shows a perspective view of a valve array and (in an exploded view) the different parts of an electric connecting device, according to the invention;

FIG. 2 shows a perspective view of the valve array of FIG. 1 with the electric connecting devices being completely mounted; and

DESCRIPTION OF A PREFERRED EMBODIMENT

Figure 3A:
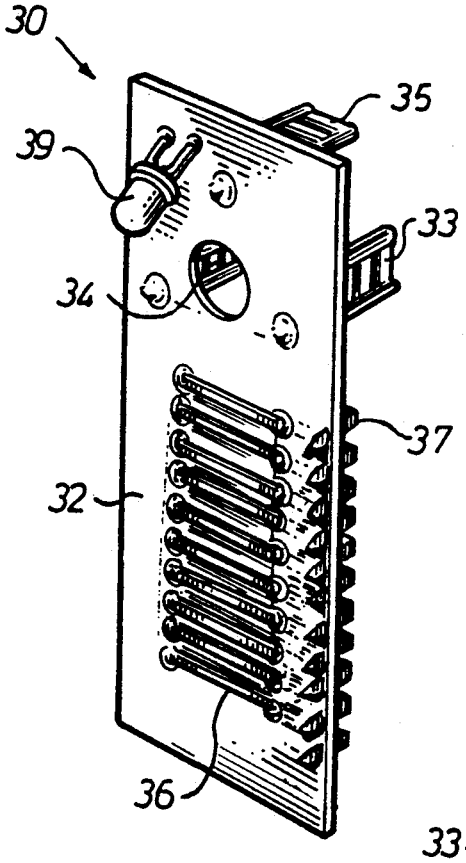

The valve array shown in FIG. 1 comprises a number (in this case five) of serially connected, pneumatic main valves 1–5 being part of a compact control system. The valves 1–5 are mounted on supporting, mutually fastened (by screw fasteners, not shown) mounting plates 6–10, with a common inlet 11 for pressurized air and likewise common outlet ports 12, 13 (connected to a connecting portion 14 which is only shown in FIG. 2). The mounting plates 6–10 are at the underside (not shown), provided with inlet and outlet ports connected e.g. to pneumatic control cylinders.

The main valves 1–5, which in the embodiment are constructed as directional valves, are in turn controlled by pilot valves 21–25, which at the bottom are connected to the respective valves 1–5 through inlet and outlet ports (not visible) and at the top are provided with a solenoid part which is electrically connected to three flat contact pins 26, 27, 28, namely for the connection to signal, zero and earth conductors of a common interconnecting cable 29 by way of an electric plug-in module 30.

Figure 3B:
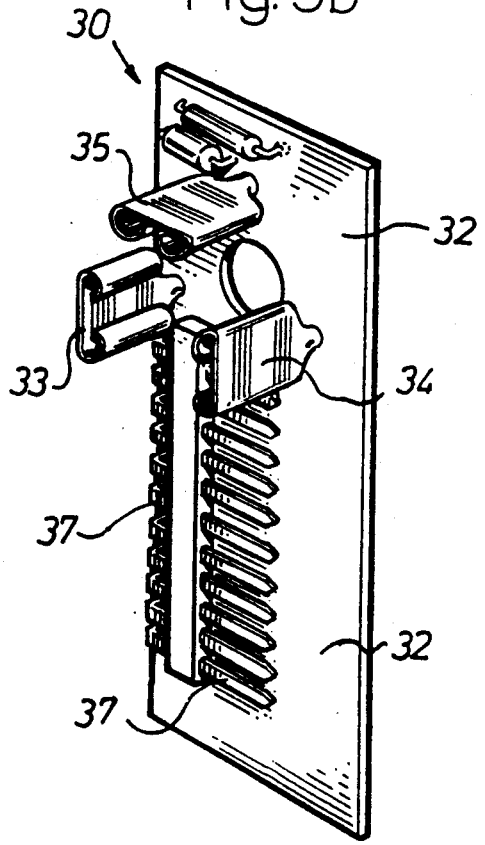

In FIG. 1, only the plug-in module 30 belonging to the pilot valve 21 is shown (the others are built up in a similar manner), said module 30 essentially comprising a coupling plate in the form of a rectangular circuit board 32 contained in a protective housing 31*a*, 31*b* and being provided with three contact sockets 33, 34, 35 (see also FIGS. 3*a* and 3*b*), an array of electric connections in the form of contact bridges 36, a multipolar contact means 37 for connecting to a multipolar cable contact means 38, which is connected to the connecting cable 29, as well as other electrical components, i.a. a light emitting diode for operational indication and a variator 40 for the protection against transients in the current supply of the magnet coil of the pilot valve The contact sockets 33, 34, 35 of the plug-in module fit onto the respective flat contact pins 26, 27, 28 and serve as combined contact and suspension means for the plug-in module 30. The contact sockets 33, 34 35 are connected to the contact bridge 36 through conductors on the circuit board 32. The contact bridges are connected to the multipolar contact means 37 through conductors on the circuit board 32 (on the rear side thereof). The contact bridges 36 consist of sheet metal contact elements, which before, during or after the installation can be broken away, for example, with a screw driver or the like, so that only one or some of the signal conductors of the inter connecting cable 29 are connected to the signal contact pin of a particular pilot valve.

The multipolar contact means 37, which is located on the rear side of the circuit board 32, and the pins thereof are angled in such a way that the multipolar cable contact means 38, which is formed as a socket contact, lies flat and is parallel to the rear side of the circuit board 32 when connected.

Thus, the contact pins 26, 27, 28 of the pilot valve 21 will be connected to the earth and zero conductors of the inter connecting cable 29 after mounting of the plug-in module 30 (and breaking of the desired sheet metal contact elements of the contact bridges 36) and to one or more of the signal conductors for the desired control of the pilot valve 21 (and the other pilot valves in a corresponding manner) from a number of signal generators or a central control unit (not shown), possibly through a decoder (not shown).

As shown in FIGS. 1 and 2, the connecting cable 29 is of flat cable type, i.e. in the form of a plastic ribbon with a plurality of parallel conductors placed between surrounding strips of a synthetic material. The flexible flat cable 29 is divided into a number of portions 29*a* , 29*b* , 29*c* etc. connected in series (see FIG. 2), over the respective flat socket contact means 38, which portions preferably form curved loops between the plug-in-modules 30. The loop or flat cable portion 29*a* is connected to an ordinary multi-wire cable 42 through a connector 41.

It is obvious that the described arrangement facilitates a very simple electric connection of the pilot valves without any separate conductors having to be connected, e.g. by soldering, to the respective contact pin 26, 27, 28 or to any other contact means. The only thing that has to be done is to press the contact sockets 33, 34, 35 onto the contact pins 26, 27, 28 and to break some of the sheet metal contact elements. If an altered function is desired, the particular circuit board may be exchanged, whereby the connection to the pilot valve and the cable contact means can be made fast easy. The cable 29 is then kept intact.

When mounted, the circuit board with its conductors, components and contact means is protected by the two-part protective housing, the inside part 31*a* of which is tightly attached to the outside of the pilot valve housing (around the contact pins 26, 27, 28) and the outer part or cap 31*b* of which is tightly attached to the inner part 31*a* along with elastic seals 43 and 44, respectively. The circuit board 32 lies approximately flush with the partition line of the protective housing 31*a* , 31*b* , and the flat cable portions 29*a* , 29*b* lie flat between the seals 43, 44, so that no special lead-through arrangements are needed.

The protective housing, at least its cap 31*b* , is transparent, whereby it is possible to check whether the light emitting diode 39 is lit up when the pilot valve in question is activated.

The whole plug-in module 30 with its protective housing 31*a* , 31*b* is fastened by means of fastening screws 45.

The described connecting device may be modified within the scope of the following claims. In principle, conventional cables may be used instead of the flat or ribbon cable portions 29*a* , 29*b* etc. Further, the electric interruptable connection may be made in any other way, for instance as switches, so that the contact function may be altered without exchanging the circuit board in the respective plug-in module. The protective housing 31*a* , 31*b* may be omitted if there is no demand for protection against dust, flushing or the like.

What is claimed:

1. An electric connecting device for selectable connection of a number of electrically controllable fluid valves, disposed in a modular array, to specific conductors in an interconnecting multi-conductor cable, the fluid valves including contact pins, said device comprising:

a number of multipolar cable contact means interconnected between flexible portions of said multi-conductor cable;

a number of plug-in modules each mountable onto a respective one of said fluid valves and electrically connectable to said multipolar cable contact means;

each of said plug-in modules including:

a coupling plate provided with contact sockets sized and arranged for direct connection to the contact pins of an associated fluid valve;

a multipolar contact means connectable to one of said multipolar cable contact means; and an array of interruptable electric connections between said multipolar contact means and said contact sockets, whereby the respective plug-in modules being programmable for achieving a selectable connection between the contact pins of the associated fluid valve and the specific conductors of the interconnecting cable.

2. A connecting device according to claim 1, wherein said interruptable electric connections comprise mechanically breakable short-circuit sheet metal elements.

3. A connecting device according to claim 1, wherein said interconnecting cable is a flat cable.

4. A connecting device according to claim 3, wherein the ends of two adjoining flat cable portions are jointly connected into said multipolar cable contact means.

5. A connecting device according to claim 4, wherein each of said multipolar cable contact means comprises a longitudinal, relatively flat socket contact means extending along the width of the flat cable, and said multipolar contact means includes a corresponding pin contact means attached to said coupling plate.

6. A connecting device according to claim 5, wherein said pin contact means is angled in such a way that the associated socket contact means and the ends of the flat cable portions connected thereto lie parallel to the circuit board.

7. A connecting device according to claim 1, wherein said coupling plate comprises a circuit board.

8. A connecting device according to claim 7, wherein the circuit board is provided with means indicative of the operability of the device, and/or protective means.

9. A connecting device according to claim 1, wherein said contact pins of the respective fluid valve, the associated coupling plate, and said cable contact means are disposed together in an openable two-part protective housing with lead-through arrangements for said interconnecting cable.

10. A connecting device according to claim 9, wherein the coupling plate lies essentially in a partition plane of the two-part protective housing.

* * * * *